US007210682B2

(12) United States Patent
Tsuzawa

(10) Patent No.: US 7,210,682 B2
(45) Date of Patent: May 1, 2007

(54) SHEET DISTRIBUTOR, IMAGE RECORDER, AND A SHEET DISTRIBUTING METHOD

(75) Inventor: Yoshiyuki Tsuzawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 277 days.

(21) Appl. No.: 10/654,939

(22) Filed: Sep. 5, 2003

(65) Prior Publication Data

US 2004/0046316 A1 Mar. 11, 2004

(30) Foreign Application Priority Data

Sep. 6, 2002 (JP) ..... 2002-261472

(51) Int. Cl.
*B65H 39/10* (2006.01)

(52) U.S. Cl. ..... 271/296; 271/298; 271/299; 271/300; 271/302; 271/176

(58) Field of Classification Search ..... 271/298–300, 271/302, 287, 176, 296; 430/403, 434; 198/369.1, 198/358, 437
See application file for complete search history.

(56) References Cited

U.S. PATENT DOCUMENTS 3,301,550 A * 1/1967 Gunter ..... 271/272
4,480,825 A * 11/1984 Landa ..... 271/81
4,602,778 A 7/1986 Hirose et al.
4,823,159 A * 4/1989 Yamamoto et al. ..... 399/394
5,219,159 A * 6/1993 Malachowski et al. ..... 271/228
5,273,274 A * 12/1993 Thomson et al. ..... 271/228
5,374,972 A 12/1994 Nakane et al.
5,430,520 A * 7/1995 Toki et al. ..... 396/612
5,485,989 A * 1/1996 McCay et al. ..... 271/2

(Continued)

FOREIGN PATENT DOCUMENTS

DE 41 30 565 C1 11/1992

(Continued)

*Primary Examiner*—Patrick Mackey
*Assistant Examiner*—Matthew J. Kohner
(74) *Attorney, Agent, or Firm*—Sughrue Mion, PLLC

(57) ABSTRACT

The invention provides a sheet distributor and a sheet distributing method. The sheet distributor with which supplied sheets of a specified length are distributed to a plurality of lines of sheets, has a transport unit which keeps transporting each supplied sheet in a transport direction while the sheet is being distributed, a moving unit which moves said transport unit laterally in a perpendicular direction to the transport direction, a position detecting sensor which detects a position of a advancing end of the sheet in the transport direction when the sheet is transported and a control section that controls the start of the movement of said moving unit in accordance with a timing of detecting the advancing end of the sheets. The sheet is moved in a direction oblique to the transport direction during transporting such that a position of the sheet in a widthwise direction is changed at each time of sheet supply, whereby supplied sheets are arranged in a plurality of lines. The sheets distributor is incorporated in a image recorder which has a recording section that records an image on the recording material in transport by scanning in the a widthwise direction.

18 Claims, 9 Drawing Sheets

U.S. PATENT DOCUMENTS

| | | | | |
|---|---|---|---|---|
| 5,541,042 | A * | 7/1996 | Ura et al. | 430/403 |
| 5,724,626 | A * | 3/1998 | Todoki | 396/612 |
| 5,984,304 | A * | 11/1999 | Wacker | 271/288 |
| 6,032,945 | A * | 3/2000 | Miura | 271/122 |
| 6,179,495 | B1 * | 1/2001 | Sugata et al. | 396/612 |
| 6,273,418 | B1 * | 8/2001 | Fujikura et al. | 271/228 |
| 6,533,268 | B2 * | 3/2003 | Williams et al. | 271/228 |
| 6,612,571 | B2 * | 9/2003 | Rider | 271/279 |
| 6,736,394 | B2 * | 5/2004 | Herrmann et al. | 271/249 |
| 6,866,260 | B2 * | 3/2005 | Williams et al. | 271/227 |

FOREIGN PATENT DOCUMENTS

| | | |
|---|---|---|
| EP | 0 626 619 A2 | 11/1994 |
| EP | 0 670 519 A1 | 9/1995 |
| JP | 60-153358 | 8/1985 |
| JP | 9-329885 | 12/1997 |
| JP | 11-349191 | 12/1999 |
| JP | 3086985 B | 7/2000 |

* cited by examiner

START OF EXPOSURE FOR RECORDING
END
START OF EXPOSURE FOR RECORDING
END

S1 S2

ΔT1
S3 S4
PASS OF CUT SHEET

START OF DISTRIBUTION
END

ΔT2
END
START OF DISTRIBUTION

SHEET DISTRIBUTOR, IMAGE RECORDER, AND A SHEET DISTRIBUTING METHOD

BACKGROUND OF THE INVENTION

This invention relates to a sheet distributor that receives sheets of a photographic material and the like as they are being transported after they were cut to a specified length and which then distributes those sheets so as to transport them in a plurality of lines. The invention also relates to an image recorder using such sheet distributor, as well as a sheet distributing method.

Printers operating on digital exposure have been put on the market in recent years. They are commonly called digital photoprinters and perform the following operations: the image recorded on a film is read photoelectrically and the image thus read is converted to digital signals which are subjected to various image processing steps to produce recording image data; the light-sensitive material is exposed by scanning with optical beams modulated in accordance with the image data so as to record an image (latent image), which is subjected to development and other necessary treatments to make a print (photograph) which is then output.

The digital photoprinter is basically composed of two parts, an input device having a scanner (image reader) and an image processing unit, and an output device having a printing unit (image recorder) and a processor (developing machine).

In the scanner, the projected light from the image recorded on a film is read photoelectrically with an image sensor such as a CCD sensor and sent as the image data for the film (image data signals) to the image processing unit. In the image processing unit, the image data is subjected to specified image processing steps and sent to the printing unit as image data (exposure conditions) for image recording.

In the printing unit, if it is of a type that operates on exposure by scanning with optical beams, a web of light-sensitive material in roll form is drawn by a specified length, cut to a sheet and transported to the exposing position. The optical beams modulated in accordance with the supplied image data are deflected in the main scanning direction while the cut sheet of light-sensitive material is transported in the auxiliary scanning direction which is perpendicular to the main scanning direction. In the processor, the exposed light-sensitive material is subjected to specified development and other necessary treatments to make a print that reproduces the image recorded on the film.

The digital photoprinter requires that a large volume of prints be output in high efficiency and to this end the light-sensitive material has to be exposed by scanning and developed within a short period of time. This raises the need to improve the efficiency of development and subsequent treatments and in order to perform those treatments on the light-sensitive material as it is being transported in a plurality of lines, various types of distributor have been proposed that can distribute sheets of the light-sensitive material into a plurality of lines for subsequent transport.

In the digital photoprinter, optical beams are scanned through a preset range of area in order to expose the light-sensitive material being transported and it is particularly desired that no image be recorded askew or off center (offset) on the light-sensitive material. From this viewpoint, post-exposure distributing is desired that distributes sheets of the as-exposed light-sensitive transport.

JP 9-329885 A discloses in paragraphs 0120–0129 and 0161–0165 a photographic printing and developing apparatus having a distributor by means of which sheets of photographic paper that have been preliminarily cut to a desired size and then exposed for printing are distributed for transport in two lines, right and left, downstream the transport path and which has a first roller pair and a second roller pair, each consisting of a driving roller and a driven roller, that are provided along the transport path, and a carriage for causing the first and second roller pairs to reciprocate to the right and left of the transport path.

Japanese Patent 3086985 discloses in paragraphs 0014–0017 a photographic distributor which receives exposed cut sheets of photographic paper and distribute them into a plurality of lines relative to the direction in which the photographic paper advances (the direction of its transport), with the distributed sheets of photographic paper being then fed, either simultaneously or consecutively, into an automatic developing machine connected or positioned downstream.

The distributors disclosed in those references are each intended for application to an analog photographic printing unit which performs exposure of the image on a film by directly printing it on photographic paper as the light-sensitive material using the projected light that has passed through the image. If such distributors are applied to the digital photoprinter under consideration, the following disadvantages will occur.

Those distributors each adopt a control sequence by which sheets of the exposed light-sensitive material in transport are brought to a temporary stop in the distributor, distributed right and left, and start to be transported again. This process consisting of transporting sheets of the light-sensitive material, bringing them to a stop, distributing them and transporting them again can be easily realized in the above-described analog photographic printing unit. To be more specific, the printing units disclosed in JP 9-329885 A and Japanese Patent 3086985 are analog photographic printing units that allow the image on a film to be directly printed on the light-sensitive material (photographic paper) by focusing projected light, so they have a control sequence that transports the light-sensitive material to the print position and brings it to a temporary stop for a sufficient period of time to perform printing. Hence, the analog photographic printing units have the advantage that a control sequence comprising the steps of transporting the light-sensitive material, bringing it to a stop and transporting it again can be easily incorporated into the distributor.

However, in the digital photoprinter, an image is recorded on the light-sensitive material in transport by scanning optical beams over it in a direction perpendicular to the direction in which it is being transported, so the control sequence involving the step of bringing the light-sensitive material to a temporary stop is absent. Alternatively, exposure is performed by a control sequence that controls the gap (distance) between successively transported sheets of light-sensitive material and development that follows exposure is also performed by a control sequence that controls the gap between successively transported sheets of light-sensitive material. Therefore, incorporating in the distributor an additional time-based control sequence that includes the step of bringing the light-sensitive material to a stop is extremely difficult in the technical development of practically feasible and cost-effective digital photoprinters.

Consider, for example, the step of unrolling a specified length of light-sensitive material and cutting it into sheets. This cutting step is performed at specified time intervals on the basis of the gap between sheets of light-sensitive material that was preliminarily set in accordance with the throughput of the exposing and developing processes. So if a transport stop time is provided for the distributor in the transport path of the light-sensitive material in the case of realizing the process in which sheets of the light-sensitive material are developed and otherwise treated as they are sequentially spaced apart in the direction of transport, the time interval of cutting the light-sensitive material must be controlled in consideration of the stop time and the control sequence becomes complicated.

In order to increase the throughput of print processing, the transport speed of the light-sensitive material may be increased. If, in this case, sheets of light-sensitive material are brought to a stop and distributed into a plurality of lines, they will be approached by ensuing sheets of light-sensitive material and this makes it necessary to increase the speed of distribution with the increasing speed of transport. In fact, however, the speed of distribution cannot be increased beyond a certain limit and the transport capacity is also limited.

In the distributor disclosed in JP 329885 A, the first roller pair and the second roller pair are designed to make sliding contact with the thrust bush in the carriage (see paragraph 0129 and FIG. 25), so the thrust bush and the rollers will wear away as the use of the distributor is prolonged. In consequence, as the transport speed increases, extra resistance may occur or the direction of transport may become significantly askew, leading to impaired durability. Thus, the distributors disclosed in JP 329885 A and Japanese Patent 3086985 are limited in the capacity of transporting the recording material and the durability of the former is low on account of the device configuration.

SUMMARY OF THE INVENTION

An object, therefore, of the present invention is to provide a sheet distributor and a sheet distributing method by which sheets of a specified length being transported can be distributed for transport in a plurality of lines at a higher speed with better durability than it has been possible in the prior art.

Another object of the invention is to provide a practically feasible, cost-effective image recorder that employs the sheet distributor and which is adapted to a control sequence of the type incorporated in the digital photoprinter.

The first object of the invention can be attained by a sheet distributor with which supplied sheets of a specified length are distributed to a plurality of lines of sheets, comprising a transport unit which keeps transporting each supplied sheet in a direction of transport while the sheet is being distributed, a moving unit which moves the transport unit laterally in a direction perpendicular to the direction of transport of the sheet when the sheet is transported by means of the transport unit, a position information obtaining device which obtains information on a position of the sheet in the direction of transport when the sheet is transported by means of the transport unit and a control section that controls the start of the movement of the moving unit in accordance with the information on the position as obtained from the a position information obtaining device.

The information on a position of the sheet in the direction of transport is, for example, information on a position of an advancing end of the sheet. When the sheet is supplied at a constant transport speed to the sheet distributor after the sheet is processed such as recording, a lapse of time after the process ends may be used as the information on the position of the sheet.

The transport unit preferably has a driving roller and a nip roller which cooperates with the driving roller to nip and transport a sheet. In this case, the moving unit preferably moves the driving roller and the nip roller laterally while a sheet is being transported by means of the driving roller and the nip roller.

The transport unit specifically may be composed of two roller pairs, each consisting of the driving roller and the nip roller, that are respectively located upstream and downstream in the direction of transport. In this case, the moving unit may be a moving table that is free to move laterally carrying the two roller pairs. Alternatively, the transport unit may be composed of one driving roller and two nip rollers facing the driving roller that are located upstream and downstream in the direction of transport.

The position information obtaining device is preferably a position detecting sensor that detects the position of the sheet in the direction of the transport. In this case, the control section controls the start of the movement of the moving unit in accordance with a timing of detecting the position of the sheet as obtained from the position detecting sensor.

The second object of the invention can be attained by an image recorder that records a desired image on a specified length of recording material in sheet form being transported, comprising a recording section and a recording material distributing section.

The recording section records an image on the recording material in transport by scanning in a direction perpendicular to the direction of transport of the recording material. The recording material distributing section is provided downstream of the recording section in a direction of transport and with the distributing section supplied sheets of the recorded recording material are distributed to a plurality of lines. The recording material distributing section comprises a transport unit which keeps transporting each supplied sheet of the recording material with the recorded image in the direction of transport while it is being distributed, a moving unit which moves the transport unit laterally in a direction perpendicular to the direction of transport of the recording material when it is transported by means of the transport unit, a position information obtaining device which obtains information on a position of the sheet in the direction of transport when it is transported by means of the transport unit and a control section that controls the start of the movement of the moving unit in accordance with the information on the position as obtained from the a position information obtaining device.

The information on a position of the sheet in the direction of transport is, for example, information on a position of an advancing end of the sheet. When the sheet is supplied at a constant transport speed to the sheet distributor after the sheet is processed such as recording, a lapse of time after the process ends may be used as the information on the position of the sheet.

The position information obtaining device is preferably a position detecting sensor that detects the position of the sheet in the direction of the transport. In this case, the control section controls the start of the movement of the moving unit in accordance with a timing of detecting the position of the sheet as obtained from the position detecting sensor.

The image recorder preferably has a multiple-line transport mode and a single-line transport mode. The former mode is such that sheets of the recording material are distributed by the recording material distributing section to transport the sheets in a plurality of lines. The latter mode is such that sheets of the recording material are not distributed by the recording material distributing section but are transported in a single line. Either mode of the multiple-line transport mode and the single-line transport mode is chosen and controlled by the control section.

The transport unit preferably has a driving roller and a nip roller which cooperates with the driving roller to nip and transport the recording material. For example, the transport unit may have two roller pairs each pair consisting of the driving roller and the nip roller, that are respectively located upstream and downstream in the direction of transport. In this case, the moving unit may be a moving table that is free to move laterally carrying the two roller pairs. Alternatively, the transport unit may be composed of one driving roller and two nip rollers facing the driving roller that are located upstream and downstream in the direction of transport.

The nip roller of the transport unit in the recording material distributing section is preferably free to move relative to the driving roller so as to disengage the recording material out of the nipped state; and the nip roller of the transport unit cooperates with the driving roller to nip the recording material in the multiple-line transport mode and moves away from the driving roller so as to disengage the recording material out of the nipped state in the single-line transport mode.

The control section preferably chooses the single-line transport mode in a case where the length of the sheet of the recording material in the direction of transport is greater than the distance from the recording position where scanning is performed in the recording section to the nip roller that is located downstream of the recording section in the direction of transport.

The recording material in sheet form may have its length set from among a plurality of predetermined lengths and provided by cutting to the specified length. In this case, the transport unit preferably has two roller pairs, each of which consists of the nip roller and the driving roller, located away from each other in a distance in the direction of transport, and the distance is shorter than the length which is the shortest of all settings for the length of the recording material in the direction of transport.

The image recorder preferably has a delivery section for delivering the recording material into a post-processing unit and the delivery section has delivery roller pairs provided downstream of the recording material distributing section in the direction of transport. In this case, the moving unit completes its lateral movement before the advancing end of the recording material being transported from the recording material distributing section reaches one of the delivery roller pairs in the delivery section that is the closest to the recording material distributing section. Then, the delivery section preferably adjusts the transport speed such that it matches the transport speed in the post-processing unit.

The image recorder preferably has an auxiliary scan receiving section between the recording section and the recording material distributing section. The auxiliary scan receiving section has a roller pair and supports a portion of the recording material that projects from the recording section as the result of transport during recording in the recording section. The roller pair in the auxiliary scan receiving section comprises a driving roller and a nip roller that is free to move relative to the driving roller so that it is free to disengage the recording material out of the nipped state.

The recording material distributing section is preferably provided in a cornering portion of the recording material's transport path such that during distribution in the recording material distributing section, the direction of transport is changed to become out-of-plane with respect to the recording surface of the recording material.

The scanning for recording in the image recording section of the image recorder includes scanning by exposing light sensitive material not only to laser beam, but also to light beam from electroluminescence light emitting elements. In addition, it includes scanning by ejecting droplets of ink on cut sheet paper for printing. The image recording section may scan in the direction perpendicular to the direction of the transport to record an image, line by line or lines by lines.

The invention also provides a sheet distributing method by which supplied sheets of a specified length being transported are arranged in a plurality of lines and transported, comprising steps of keeping transporting of each supplied sheet in a direction of transport; and moving the sheet in a direction oblique to the direction of transport during transporting, such that a position of the sheet in a widthwise direction perpendicular to the direction of transport in the transport path is changed at each time of sheet supply, whereby supplied sheets are arranged in a plurality of lines.

In the invention, sheets or recording material in sheet form to be distributed are supplied not only in a single-line. It may be supplied in a plurality of lines. Namely, the distribution of sheets or recording material in the invention includes distribution from a plurality of lines of sheets to more plural lines as well as from a single line to a plurality of lines.

DETAILED DESCRIPTION OF THE INVENTION

On the pages that follow, the sheet distributor, image recorder and sheet distributing method of the invention are described in detail with reference to the preferred embodiment shown in the accompanying drawings.

Figure 1:
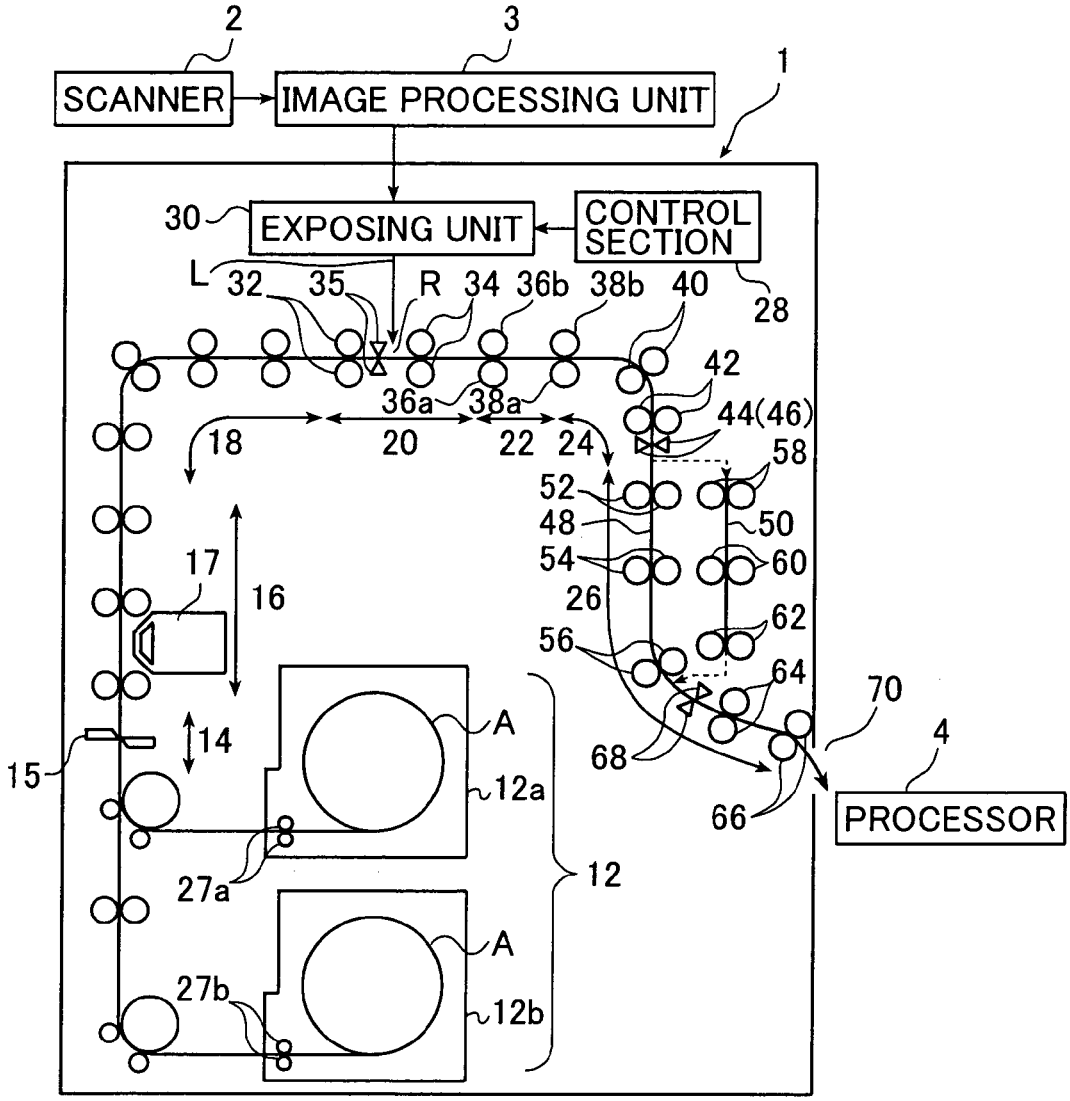
FIG. 1 is a schematics diagram showing an outline of the configuration of a printer as an example of the image recorder of the invention.

FIG. 1 is a schematic diagram showing an outline of the configuration of a printing apparatus (hereunder sometimes referred to as printer) 1 that operates on digital exposure and which is an example of the image recorder of the invention that employs the sheet distributor of the invention.

The printer 1 is a recording apparatus which, together with a scanner 2, an image processing unit 3 and a processor 4, forms a digital printer and performs recording on a light-sensitive material through exposure by scanning with optical beams. In the printer 1, a web of light-sensitive material A in roll form is drawn out by a specified length, cut into a sheet and transported to the exposing position, whereas optical beams L modulated in accordance with the image data supplied from the image processing unit 3 are deflected in the main scanning direction while, at the same time, the light-sensitive material in the form of a cut sheet is transported in an auxiliary scanning direction perpendicular to the main scanning direction, whereby the optical beams L scan over the light-sensitive material to expose it and form a latent image.

The printer 1 is connected to the image processing unit 3 which in turn is connected to the scanner 2. The processor 4 is connected adjacent the printer 1 such that it receives the exposed light-sensitive material emerging from the printer 1.

Note that the printer 1 has a control section 28 that controls its operation.

The scanner 2 photoelectrically reads the projected light from the image on the film with an image sensor such as a CCD sensor, picks up the image data associated with the film (image data signals) and send them to the image processing unit 3.

In the image processing unit 3, the supplied image data is subjected to specified image processing steps and then sent to the printing apparatus as image data (exposing conditions) for recording an image. Note that image processing unit 3 may be so configured that the image data as obtained by shooting with a digital still camera or the like is sent to the printing apparatus.

In the processor 4, the exposed light-sensitive material bearing the latent image is subjected to specified development and other processing steps, thereby producing a print that reproduces the image on the film.

The printer 1 is so configured that various processing steps are performed on the cut sheet of light-sensitive material in transport which has been obtained by cutting a web of light-sensitive material in roll form to a specified length. The printer 1 comprises, in order from the end that is upstream in the direction of transport, a supply section 12, a cutter section 14, a back printing section 16, a registering section 18, an exposing section 20, an auxiliary scan receiving section 22, a distributing section 24, and a delivery section 26. At each of those sites, rollers and roller pairs each consisting of a driving roller and a nip roller pairing with it are provided along the transport path.

The supply section 12 is a site loaded with magazines 12*a* and 12*b*, each comprising a lightfast case containing a web of light-sensitive material A that is in roll form with the recording surface facing outward.

Magazines 12*a* and 12*b* usually contain different kinds of light-sensitive material A such as those which differ in the size (width) of light-sensitive material A, the type of the light-sensitive surface (e.g. whether it is of silk finish or matte finish), the specifications (e.g. thickness and base type), etc. In the embodiment under consideration, the supply section 12 has two magazines but this is not the sole case of the invention and one magazine or three or more magazines may be employed.

The light-sensitive material drawn out of magazine 12*a* or 12*b* is sent to the cutter section 14.

The magazines 12*a* and 12*b* have drawing roller pairs 27*a* and 27*b*, respectively, for drawing the light-sensitive material A out of the magazines 12 and transporting it. The drawing roller pairs 27*a* and 27*b* draw out a specified length of the light-sensitive material A in accordance with the length of print so as to make a specified length of cut sheet in the cutter section 14 and they then stop drawing the light-sensitive material A.

The cutter section 14 has a cutter 15 by means of which the light-sensitive material drawn out of the magazine 12*a* or 12*b* is cut to a specified length on the basis of a control signal being sent from the control section 28 in the printer 1. The cut sheet of the specified length is thereafter sent to the back printing section 16.

The back printing section 16 is a site where a so-called back print consisting of various kinds of information including the shooting date, print date, frame number, film ID number (symbol), ID number of the camera used in shooting and ID number of the photoprinter is recorded (to effect back printing) on the basis of a control signal from the control section 28.

The cut sheet is transported upward by means of the rollers and roller pairs as the back print is recorded by means of a back print head 17. The back print head 17 may be exemplified by known print heads including an ink-jet head, a dot impact print head and a thermal transfer print head. Note that the back print head 17 is adapted to the Advanced Photo System and permits printing in two or more lines.

The registering section 18 is a site where the cut sheet of the specified length in transport has its skew or widthwise position adjusted such that it is not oblique to the transport path but lies at a specified widthwise position in the transport path. On account of this registering section, exposure/recording in the exposing section 20 as a subsequent step can be performed by scanning at a specified position in the cut sheet. In the registering section 18, the cut sheet may have its skew or widthwise position adjusted by any known methods such as, for example, the methods of adjusting the skew or widthwise position that are disclosed in JP 60-153358 A and JP 11-349191 A.

Having passed through the registering section 18, the cut sheet changes the direction of its transport from upward to horizontal as shown in FIG. 1 and is further transported to the exposing section 20.

The exposing section 20 is composed of an exposing unit 30 connected to the image processing unit 3, auxiliary scanning roller pairs 32 and 34 that are provided upstream and downstream in the direction of transport such that they are on opposite sides of the exposing position R where the cut sheet is exposed by scanning with the optical beams L issuing from the exposing unit 30 and which transport the cut sheet at a specified speed for auxiliary scanning, and position detecting sensor 35 that is provided between the exposing position R and the auxiliary scanning roller pair 32 and which detects a pass of the cut sheet.

The exposing unit 30 may be a known optical beam scanning device which employs laser beams or other optical beams as recording light. This exposing unit 30 is typically composed of the following components: light sources that issue optical beams L in respective association with exposing of the cut sheet to red (R) light, green (G) light and blue (B) light; modulating means such as AOM (acousto-optic modulator) which modulates the optical beams L from those light sources in accordance with the processed image data being supplied from the image processing unit 3; a light deflector such as a polygonal mirror which deflects the modulated optical beams L in a direction (main scanning direction) perpendicular to the direction of transport, and a mirror for adjusting the optical path of an fθ (scanning) lens such that the optical beams L deflected in the main scanning direction are focused to a specified beam diameter at a specified position on the exposing position R.

Alternatively, one may adopt digital exposure means that employ a variety of light-emitting arrays and space modulator arrays that extend in a direction perpendicular to the direction of transport, including a PDP (plasma display) array, an ELD (electroluminescence display) array, an LED (light-emitting diode) array, an LCD (liquid-crystal display) array, a DMD (digital micromirror device, registered trademark), and a laser array.

The width over which the laser beams L perform main scanning at the exposing position R in the exposing unit 30 is so set that it is associated with the width of the cut sheet.

The above-described operation of the exposing unit 30 is controlled by the control signals from the control section 28.

The optical beams L as the recording light are deflected in the main scanning direction (normal to the paper on which FIG. 1 is drawn) as the cut sheet is transported by means of the auxiliary scanning roller pairs 32 and 34. Thus, by means of the optical beams L modulated in accordance with the image data, the cut sheet is exposed by two-dimensional scanning and a latent image is recorded.

It should be noted here that the auxiliary scanning roller pairs 32 and 34 may be replaced by a scan transport mechanism that employs an exposure drum for transporting the cut sheet as it is held in the exposing position R and two nip rollers on opposite sides of the exposing position R which are in contact with the exposure drum. Either design may be adopted as long as it is at least capable of recording an image on the cut sheet in transport by performing scanning in a direction perpendicular to the direction of transport of the cut sheet.

The auxiliary scan receiving section 22 is a site furnished with two roller pairs 36 (36*a*, 36*b*) and 38 (38*a*, 38*b*) which support the advancing end portion of the cut sheet that has come to project in the auxiliary scanning direction from the exposing section 20 as the result of transport during the process of recording in the exposing section 20. The roller pair 36 (or 38) consists of a driving roller 36*a* (or 38*a*) and a nip roller 36*b* (or 38*b*) that is free to move relative to the driving roller 36*a* (or 38*a*) so that it disengages the cut sheet out of the nipped state. The transport of the cut sheet by means of the roller pairs 36 and 38 is at the same speed as the transport by means of the auxiliary scanning roller pairs 32 and 34.

As will be mentioned later, the nip rollers 36*b* and 38*b* are so controlled that during exposure for recording, the nip roller 36*b* (or 38*b*) is away from the driving roller 36*a* (or 38*a*) so that the cut sheet is not nipped between the two rollers and when the trailing end portion of the cut sheet finishes exposure for recording, the nip roller 36*b* (or 38*b*) comes down and contacts the driving roller 38*a* (or 38*a*) so that the cut sheet is transported as it nipped between the two rollers. If the nip roller 36*b* (or 38*b*) is brought into contact with the cut sheet and the cut sheet starts to be nipped between the nip roller 36*b* (or 38*b*) and the driving roller 36*a* (or 38*a*) during its exposure for recording, small vibration will occur, causing an offset in the cut sheet exposing position or uneven exposure. The above-described control is effected in order to prevent these problems. Needless to say, the operation of the auxiliary scan receiving section 22 is controlled by control signals supplied from the control section 28. For further details, see below.

The distributing section 24 is a device composed of the following components: two roller pairs 40 and 42 which keep transporting the cut sheet at a constant speed in the direction of transport; a moving table 80 (see FIG. 2) which carries the roller pairs 40 and 42 and moves them laterally in a direction (direction of width) perpendicular to the direction of transport of the cut sheet which is being transported by means of the rollers 40 and 42; two position detecting sensors 44 and 46 which detect the position of the cut sheet in the direction of its transport as it is transported by means of the roller pairs 40 and 42; and the control section 28 which controls the start of the movement of the moving table 80 in accordance with the timing for the detection of the position of the cut sheet as obtained by the position detecting sensors 44 and 46. Being formed of those components, the distributing section 24 distributes a single line of cut sheets into two lines by size and transports them accordingly.

The position detecting sensors 44 and 46 are fixed to the moving table 80 in positions immediately downstream of the roller pair 42 in the direction of transport such that they will move together with the moving table 80 and the advancing end of the cut sheet that has passed through the roller pair 42 is detected by those sensors right after its pass. For further details, see below.

Note that the distributing section 24 corresponds to the sheet distributor of the present invention.

The distributing section 24 is provided in a cornering portion of the transport path in the printer 1 such that during distribution of cut sheets, the direction of transport is changed from horizontal to downward (out of the plane of the recording surface of the cut sheet). This design enables the cut sheet to have a curvature in a direction which is out of the plane of the recording surface of the cut sheet so that it is rendered sufficiently flexible to reduce the possibility of paper jamming, thereby allowing for smoother distribution.

In the delivery section 26, two transport paths 48 and 50 are formed, one being the closer to the viewer in the direction normal to the plane of FIG. 1 and the other away from the viewer (for better understanding, FIG. 1 is so drawn that the two transport paths are placed side by side on the paper). The transport path 48 has two roller pairs 52 and 54 and a speed regulating roller pair 56; the transport path 50 has two roller pairs 58 and 60 and a speed regulating roller pair 62. The transport paths 48 and 50 also have delivery roller pairs 64 and 66. The roller pairs 52 and 54 as well as the roller pairs 58 and 60 are so controlled that they transport the cut sheet independently of each other. Each of the roller pairs 52, 54, 58 and 60 has a driving roller and a nip roller that is free to move relative to the driving roller so that it can disengage the cut sheet out of the nipped state. Position sensor 68 is provided downstream of the speed regulating roller pairs 56 and 62 in the direction of transport so that the position of the cut sheet in the direction of transport can be detected.

Through the roller pairs 52/54 and the roller pairs 58/60, cut sheets as distributed into two lines are transported independently of each other and when the position of the advancing end of a cut sheet is detected by the position detecting sensor 68, the transport speed is reduced by the speed regulating roller pairs 56 and 62. Stated more specifically, in the transport path of the printer 1 which extends from the back printing section 16 through the registering section 18, exposing section 20, auxiliary scan receiving section 22 and distributing section 24 up to the roller pairs 52/54 and 58/60, the cut sheet is transported at a constant speed, say, 100 (mm/sec) and reduction from 100 (mm/sec) to 45.3 (mm/sec) is achieved by the speed regulating roller pairs 56 and 62. In this case, the roller pairs 52, 54, 58 and 60 are so controlled that immediately before speed reduction by the speed regulating roller pairs 56 and 62 begins, the nip rollers move away from the associated driving rollers so as to disengage the cut sheet out of the nipped state. The purpose of this speed reduction is to ensure matching with the speed of subsequent development and other processing steps in the processor 4.

The cut sheets being transported side by side in two lines are ejected from a delivery port 70 by means of delivery roller pairs 64 and 66 and then supplied into the adjacent processor 4.

Needless to say, the operation of the delivery section 26 is controlled by control signals supplied from the control section 28.

The control section 28 is a site connected to the position detecting sensors and a plurality of other sensors (not shown) that are provided in the above-described printer 1; upon receiving the detection signals from those sensors, the control section 28 generates control signals for controlling the operation of and processing by the various sites of the supply section 12, cutter section 14, back printing section 16, registering section 18, exposing section 20, auxiliary scan receiving section 22, distributing section 24 and the delivery section 26 and sends those control signals to the respective sites. For instance, as will be described later, the control section 28 receives the detection signals being sent from the exposing section 20 and the distributing section 24 and controls a series of operations consisting of exposure, transport and distribution. The control section 28 also chooses either mode of a double-line transport mode and a single-line transport mode, then controls the operation in the chosen transport mode. In the former mode, cut sheets are distributed by the distributing section 24 depending upon the length of the cut sheets which were cut to a specified length. In the latter mode, cut sheets are not distributed by the distributing section 24 but are transported in a single line.

In FIG. 1, the wired connection between the control section 28 and each of the various sites is omitted.

Figure 2A:
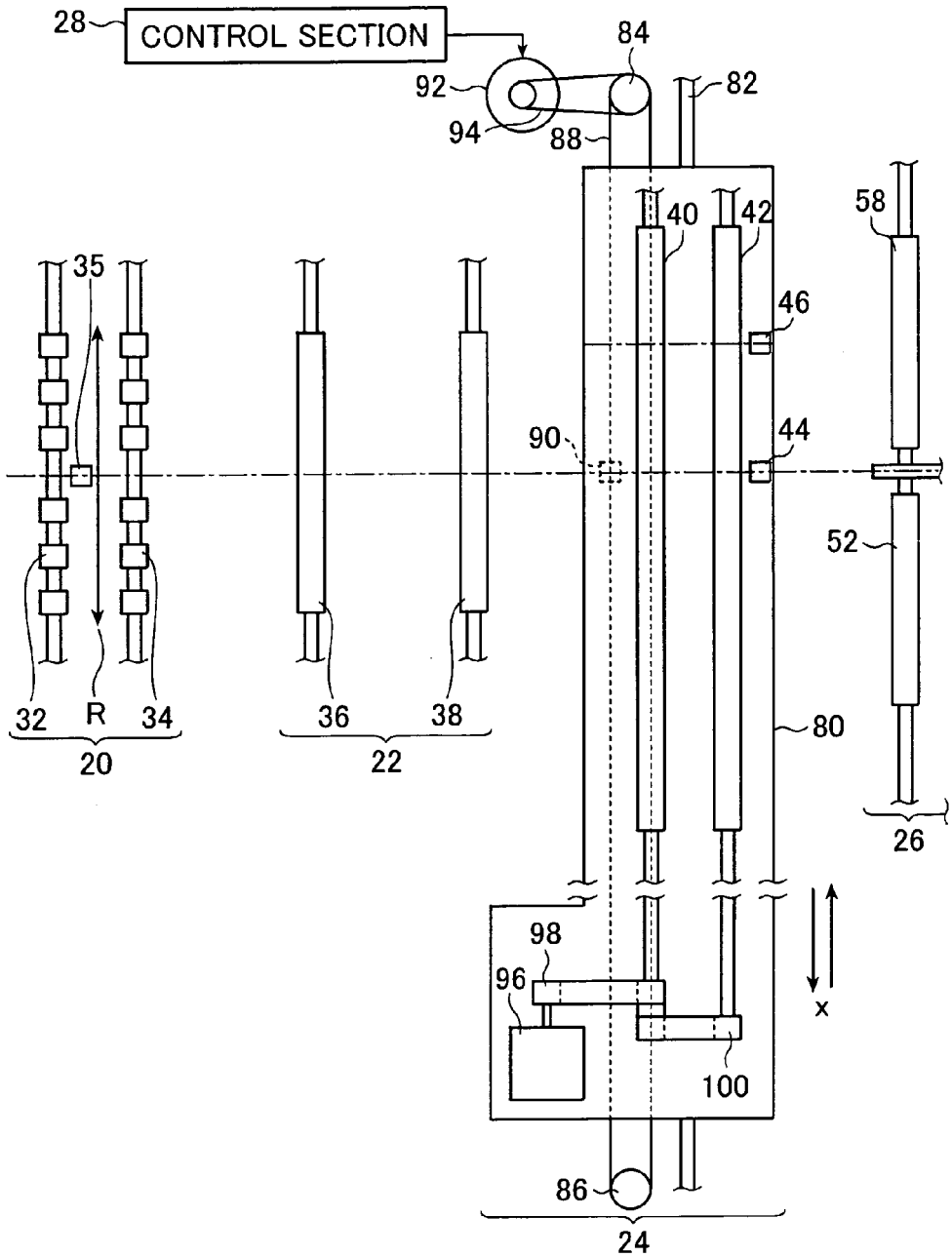
FIGS. 2A and 2B show the essential parts of the printer of FIG. 1 as they are rearranged in a plane.
Figure 2B:
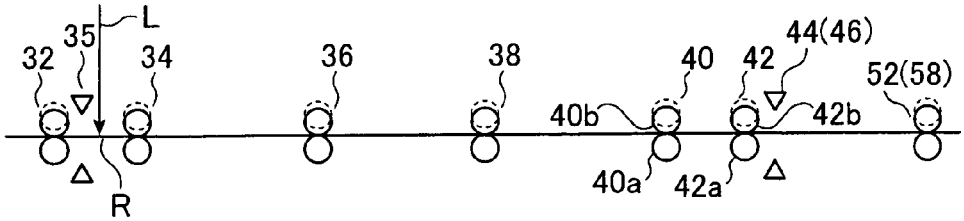

FIGS. 2A and 2B are schematic diagrams showing in part the configuration of the exposing section 20, auxiliary scan receiving section 22, distributing section 24 and the delivery section 26.

In the exposing position R, the optical beams L from the exposing unit 30 are so controlled that they perform exposure by scanning as they are deflected over a specified range in accordance with the width of the cut sheet.

As shown in FIG. 2A, the distributing section 24 is so configured that the moving table 80 carrying the roller pairs 40 and 42 is free to move along a slide rail 82 in a direction (x-direction in FIG. 2A) which is perpendicular to the direction of transport, with the slide rail 82 being fixed to the main body of the printer 1. Specifically, a timing belt 88 is provided between freely rotating pulleys 84 and 86 that are axially supported on the main body of the printer 1, with the timing belt 88 being secured by a fixing bracket 90 provided on the back side of the moving table 80. Hence, by moving the timing belt 88, one can freely move the table 80 in x-direction in FIG. 2A.

Provided around the pulley 84 is a driving belt 94 that is connected to a drive motor 92 which is driven in accordance with control signals from the control section 28 and the table 80 is adapted to move in x-direction when the drive motor 92 rotates.

The moving table 80 is also provided with a drive motor 96 for driving the driving rollers 40*a* and 42*a* (see FIG. 2B) of the roller pairs 40 and 42; it is so adapted as to transmit drive to the driving roller 40*a* via a driving belt 98 and further to the driving roller 42*a* via a driving belt 100. The drive motor 96 is so adapted that the driving rollers 40*a* and 42*a* normally rotate at a specified speed whereas the cut sheet is transported at the same speed as in the exposing section 20 and the auxiliary scan receiving section 22.

The moving table 80 is provided with the position sensors 44 and 46 that detect the advancing end of the cut sheet as it is transported from the roller pairs 40 and 42 and which are so wired that signals from them are sent to the control section 28.

Hence, the control section 28 is triggered by the detection signals obtained from the position detecting sensors 44 and 46 and generates control signals that start the driving of the drive motor 92 in accordance with the timing for detecting the position of the cut sheet, whereby the drive motor 92 can be driven. Note that the position detecting sensor 44 is used to detect the position of the cut sheet as it is being transported when the moving table 80 is in the state shown in FIG. 2A whereas the position detecting sensor 46 is used to detect the position of the cut sheet as it is being transported when the moving table 80 has moved downward from the state shown in FIG. 2A.

Movement of the table 80 begins a specified time period after position detection by the position detecting sensor 44 or 46 and ends before the advancing end of the cut sheet reaches the roller pair 52 or 58. Therefore, distribution of cut sheets is complete before the advancing end of a particular cut sheet reaches the roller pair 52 or 58.

Thus, the roller pairs 40 and 42 distribute cut sheets in x-direction while keeping them in transport at a constant speed, so the distance between a leading cut sheet and the subsequent cut sheet can be maintained constant to provide a greater latitude in increasing the transport speed. As a further advantage, the roller pairs 40 and 42 which are carried on the moving table 80 have no parts that come in slidable contact with other members (the thrust bush) as in JP 9-329885 A, supra and, hence, the roller pairs 40 and 42 will not wear significantly from prolonged use. Consequently, those roller pairs have better durability than in the prior art.

In the printer 1, the distance along the direction of transport between the positions where the auxiliary scanning roller pair 34 and the roller pair 36 are disposed, the distance along the direction of transport between the positions where the roller pair 36 and the roller pair 38 are disposed, the distance along the direction of transport between the positions where the roller pair 38 and the roller pair 40 are disposed, and the distance along the direction of transport between the positions where the roller pair 42 and each of the roller pairs 52 and 58 are disposed may typically be set at 75 mm and the distance along the direction of transport between the positions where the roller pair 40 and the roller pair 42 are disposed may be set at 30 mm. By virtue of these dimensions, one can transport cut sheets that are adapted to a minimum size of photographic prints as typified by a sheet length of 81.5 mm in the direction of transport.

In the printer 1, the length of cut sheets in the direction of transport is provided by cutting a web of light-sensitive material to a length chosen from a plurality of preliminary settings and the distance along the direction of transport between the positions where the roller pairs 40 and 42 are disposed in the distributing section 24 is shorter than the length (81.5 mm) which is the shortest of all settings for the length of cut sheets in the direction of transport. As a result, even cut sheets of the minimum length of 81.5 mm can be distributed during transport by being nipped in the roller pairs 40 and 42. In addition, the transport path is shortened and this contributes to reducing the installation space of the printer, thus enabling the construction of a compact printer.

As a further advantage, the cut sheets are distributed while they are transported as nipped in the roller pairs 40 and 42, so more correct distribution can be realized than when the cut sheets are transported as nipped by a single roller pair.

Note that the distance of the transport path from the exposing position R to the distributing section 24 is adapted to be shorter than the length of cut sheets which is the longest of all settings in the printer 1 for the transferable length of cut sheets. If the length of cut sheets in the direction of transport is longer than the distance of the transport path from the exposing position R to the roller pair 40, there is no distribution of cut sheets in the distributing section 24 and instead the cut sheets are so set that they are transported in a single line as they pass through the delivery section 26 to be fed into the processor 4. Thus, the printer 1 has two transport modes, one being a double-line transport mode in which the cut sheets are distributed by means of the distributing section 24 and transported in two lines and the other being a single-line transport mode in which the cut sheets are not distributed by means of the distributing section 24 but are transported in a single line. The control section 28 chooses a double-line transport mode or a single-line transport mode depending upon the length of the cut sheets and controls the operation in the chosen transport mode.

The reason for this choosing of the single-line transport mode or the double-line transport mode depending upon the length of the cut sheets is as follows: the throughput of the processor 4 (the number of sheets it can process per unit time) varies with the length of sheets and even if cut sheets longer than a specified length are transported in two lines, the possible improvement in throughput is not as great as expected and, conversely, the transport path from the exposing position R to the distributing section 24 is extended and the cost increases so much that there is no realizing of a compact and feasible apparatus. To be more specific, with the design for transporting all cut sheets in two lines, the distance of the transport path between the exposing position R and each of the roller pairs 40 and 42 which nip the cut sheets and transport them has to be made longer than the maximum length of transferable cut sheets in order to ensure that there will be neither misregistry in the position of exposure on the cut sheet nor uneven exposure. In order to satisfy this need, the transport path from the exposing position R to the distributing section 24 is extended and, hence, the cost increases so much as to make it impossible to realize a compact and feasible apparatus.

Therefore, it is preferred to switch from the double-line transport to the single-line transport and vice versa in accordance with the length of cut sheets considering the dependency of the throughput of the processor 4 on the length of cut sheets. For example, if the length of cut sheets exceeds 229 mm, they are not distributed but are simply transported in a single line and if they are not longer than 229 mm, they are distributed and transported in two lines. As a result, the distance from the exposing position R to the roller pair 40 in the distributing section 24 can be set at around 229 mm and hence the transport path from the exposing position R to the distributing section 24 can be made shorter than in the case of transporting all cut sheets in two lines.

Needless to say, if the width of cut sheets exceeds the width of transport in the transport paths 48 and 50 (i.e., the width of transport path in the direction of transport width), the cut sheets are to be transported in the single-line transport mode. For example, if the width of cut sheets exceeds 152 mm, the single-line transport mode is chosen.

Consequently, the two-line transport mode is chosen if the cut sheets are not wider than 152 mm and not longer than 229 mm.

In the case of single-line transport, the advancing end of a cut sheet during exposure for recording first reaches the roller pair 40, then the roller pair 42; hence, the roller pair 40 (or 42) is composed of a driving roller 40*a* (or 42*a*) and a nip roller 40*b* (or 42*b*) which is free to move relative to the driving roller pair 40*a* (or 42*a*) so that it can disengage the cut sheet out of the nipped state (see FIG. 2B). Therefore, in the single-line transport mode, the nip roller 40*b* (or 42*b*) does not cooperate with the driving roller 40*a* (or 42*a*) to nip the cut sheet (it is disengaged out of the nipped state) and in the double-line transport mode, the cut sheet is nipped between the driving roller 40*a* (or 42*a*) and the nip roller 40*b* (or 42*b*).

The auxiliary scanning roller pairs 32 and 34, the roller pairs 36 and 38, and the roller pairs 52 and 58 are composed like the roller pairs 40 and 42 in that they each have a nip roller that can disengage the cut sheet out of the nipped state.

The nip rollers may typically engage the cut sheet into the nipped state or disengage it out of the nipped state (nip ON/OFF is effected) using a well known solenoid (not shown) in accordance with control signals from the control section 28.

The distributing section 24 in the printer 1 distributes cut sheets for two-line transport but it should be noted that this is not the sole case of the present invention and the distributing section 24 may be employed to distribute cut sheets for transport in three or more lines. The distributing section 24 in the printer 1 is composed of a moving unit comprising the moving table 80 carrying the roller pairs 40 and 42 but this is not the sole case of the invention and distribution may be realized by any known methods. For example, the distributing section 24 may be composed of a moving unit having a single large-diameter driving roller and two nip rollers, one being provided upstream in the direction of transport and the other downstream so that they come into contact with the driving roller and transport the cut sheet as nipped between the driving roller and each nip roller, with both the single driving roller and the two nip rollers being free to move laterally.

Described above is the way the printer 1 is composed.

In this printer 1, cut sheets are transported in the manner described below.

The light-sensitive material is drawn by a specified length from the magazine 12 (12*a* or 12*b*) loaded in the supply section 12 and is cut in the cutter section 14 to make a cut sheet.

This cut sheet has a back print recorded in the back printing section 16 and it thereafter goes up the transport path to be transferred into the registering section 18. In the registering section 18, the cut sheet has its skew or widthwise position adjusted such that it is not oblique to the transport path but lies at a specified widthwise position in the transport path. Having passed through the registering section 18, the cut sheet changes the direction of its transport from upward to horizontal and is further transported to the exposing section 20.

In the exposing section 20, when the advancing end of the cut sheet passes by the position detecting sensor 35, the detection signal from the position detecting sensor 35 is sent to the control section 28 and the optical beams L in the exposing unit 30 are turned on so that exposure for recording starts.

FIGS. 3A–3F illustrate an exemplary flow for the transport of a cut sheet that runs in the two-line transport mode from the exposing section 20 through the auxiliary scan receiving section 22 to the distributing section 24.

The following description of the double-line transport mode is based on FIGS. 3A–3F.

Figure 3A:
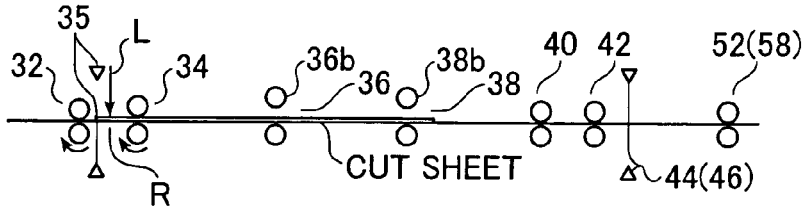
FIGS. 3A–3F illustrate an exemplary flow for the transport of a cut sheet that is performed in the printer shown in FIG. 1.

First, during exposure for recording, the advancing end of the cut sheet passes through the roller pair 36, then through the roller pair 38. In this case, the nip rollers 36*b* and 38*b* are controlled such that the cut sheet is kept disengaged out of the nipped state until after the exposure of the cut sheet ends (FIG. 3A).

Figure 3B:
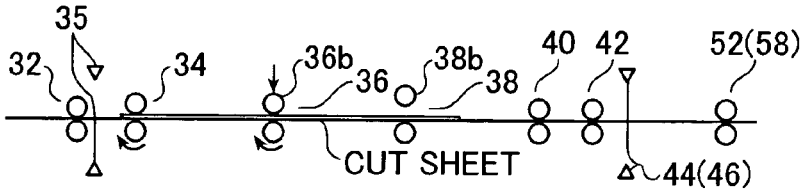
Figure 3C:
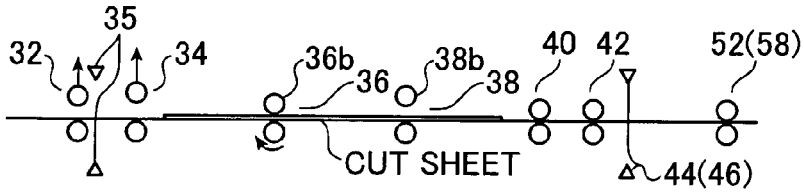

Thereafter, the passage of the trailing end of the cut sheet is detected by the position detecting sensor 35 and when the exposure of the trailing end of the cut sheet ends, the nip roller 36*b* comes down to nip the cut sheet in cooperation with the associated driving roller and the roller pair 36 cooperates with the auxiliary scanning roller pair 34 to transport the cut sheet (FIG. 3B). With further progress of the transport, the trailing end of the cut sheet passes through the roller pair 34, whereupon the nip rollers of the auxiliary scanning roller pairs 32 and 34 move upward and stay there until the next cut sheet is exposed for recording (FIG. 3C). Thereafter, the nip roller 38*b* in the roller pair 38 moves downward to nip the cut sheet in cooperation with the associated driving roller (FIG. 3D) and the cut sheet is transported by means of the roller pair 38. Note that in FIG. 3D, not only the roller pairs 36 and 38 but also the roller pairs 40 and 42 work to transport the cut sheet.

Figure 3D:
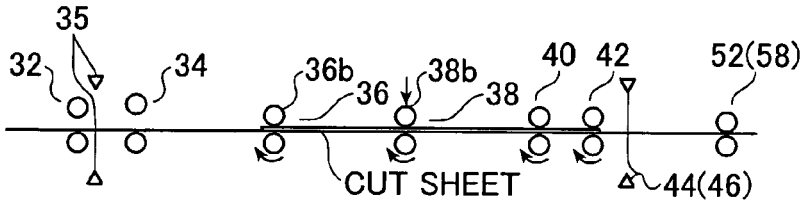
Figure 3E:
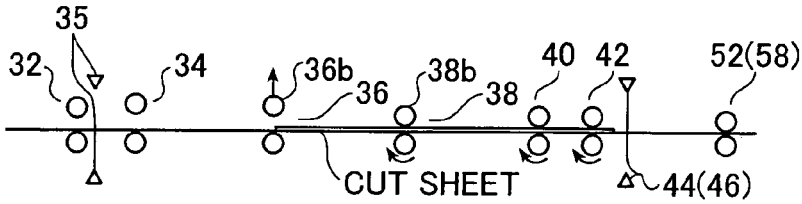

When the trailing end of the cut sheet passes through the roller pair 36*b*, the nip roller of roller pair 40 moves upward and stands by until the next cut sheet comes to the position indicated in FIG. 3B (FIG. 3E).

Figure 3F:
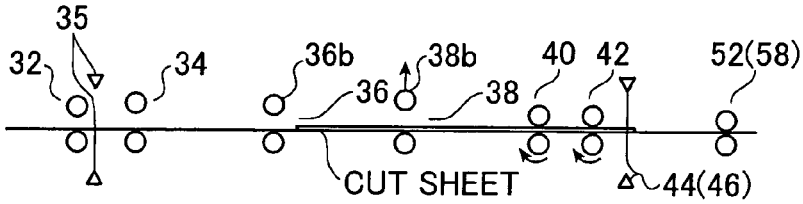

As the cut sheet is transported further and immediately before its advancing end reaches the position where the position detecting sensor 44 (or 46) is located, the nip roller 38*b* moves upward and stands by (FIG. 3F). Thus, the cut sheet is transported from the exposing section 20 to the auxiliary scan receiving section 22 and then to the distributing section 24.

In this way, the auxiliary scan receiving section 22 does not nip the cut sheet as it is being exposed for recording in the exposing position R and, instead, immediately after the end of the exposure for recording, it nips the cut sheet and transports it until just before the start of distribution by the distributing section 24. In order to ensure smooth distribution of the cut sheets, the roller pair 38 in the auxiliary scan receiving section 22 disengages the cut sheet out of the nipped state just before distribution of cut sheets.

FIGS. 4 to 7 illustrate an exemplary flow for the distribution of cut sheets.

First, the advancing end of a cut sheet passes by the position detecting sensor 44 in the distributing section 24 (FIG. 4), whereupon a detection signal is sent to the control section 28 and a control signal for driving the drive motor 92 is generated and sent to the drive motor 92. As a result, the drive motor 92 rotates counterclockwise and the table 80 moves downward in FIG. 4 until it comes to the position where the transport is taken over by the roller pair 52 (FIG. 5). Since the drive motor 96 is normally driven, the transport by the roller pairs 40 and 42 is maintained even while the table 80 is being moved. Before the advancing end of the cut sheet has reached the roller pair 52, the movement of the table 80 ends and thereafter the transport which has been effected by the roller pairs 40 and 42 is taken over by the roller pair 52. Thus, the cut sheet is guided to the transport path 48.

Figure 6:
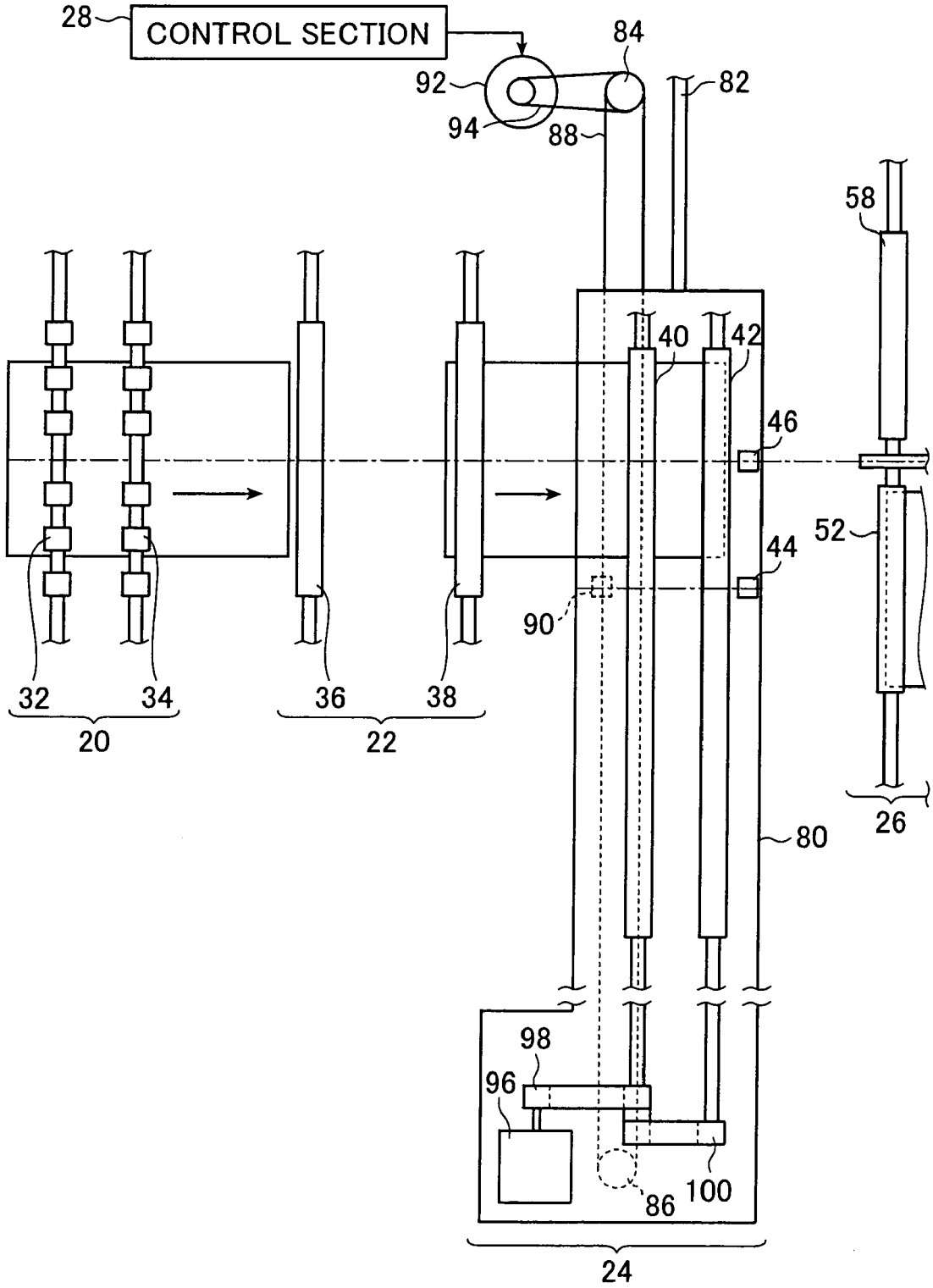
FIG. 6 illustrates yet another step in the flow for the transport of a cut sheet that is performed in the printer shown in FIG. 1.

Then, the subsequent cut sheet in transport reaches the distributing section 24 and its advancing end passes by the position detecting sensor 46 (FIG. 6).

Figure 7:
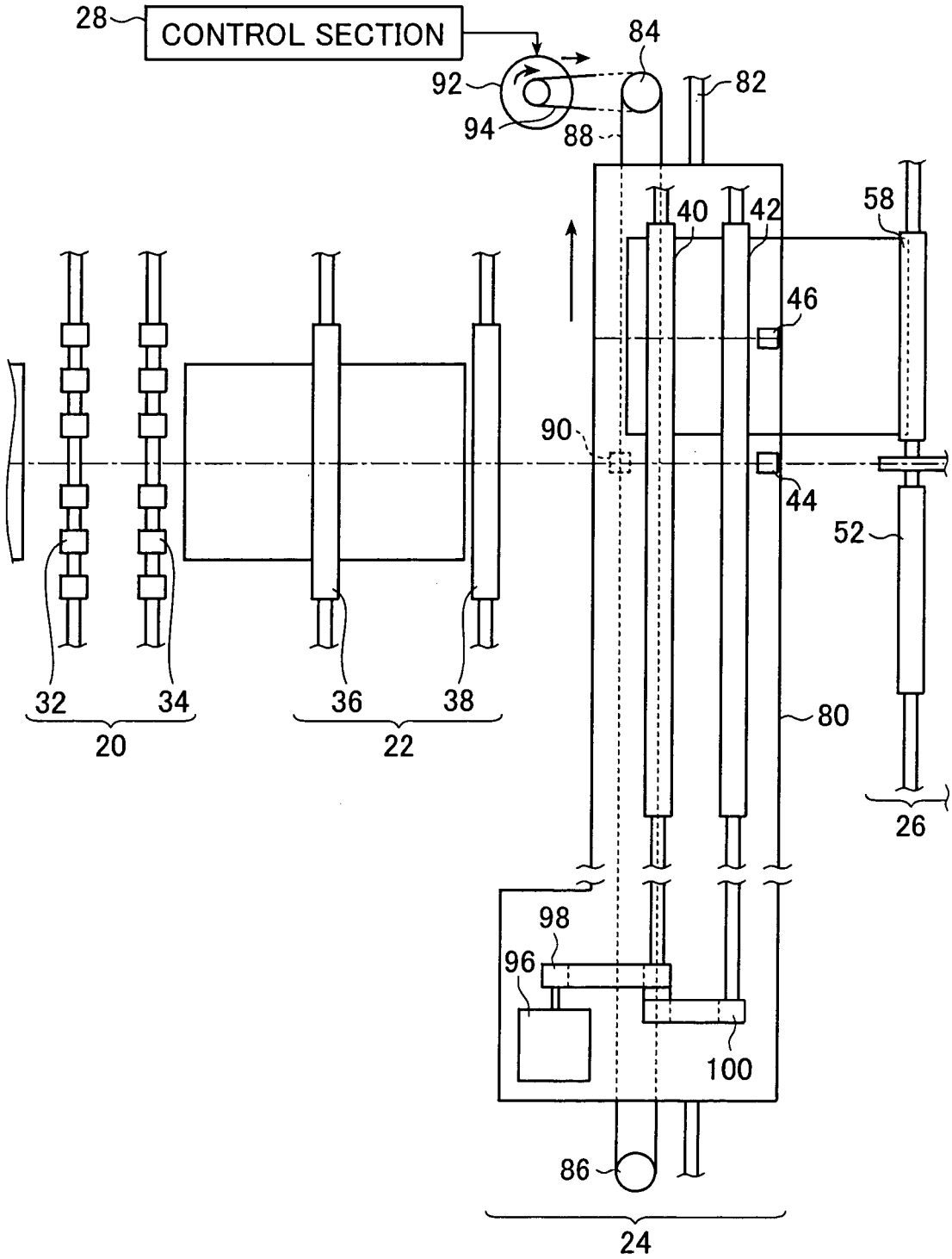
FIG. 7 illustrates still another step in the flow for the transport of a cut sheet that is performed in the printer shown in FIG. 1.

A detection signal from the position detecting sensor 46 is sent to the control section 28, whereupon a control signal for driving the drive motor 92 is generated and sent to the drive motor 92, causing the drive motor 92 to rotate clockwise. As a result, the table 80 moves upward in FIG. 6 until it comes to the position where the transport is taken over by the roller pair 58. Since the drive motor 96 is normally driven, the transport by the roller pairs 40 and 42 is maintained even while the table 80 is being moved. Before the advancing end of the cut sheet has reached the roller pair 58, the movement of the table 80 ends and thereafter the transport which has been effected by the roller pairs 40 and 42 is taken over by the roller pair 58 (FIG. 7). Thus, the cut sheet is guided to the transport path 50.

Figure 4:
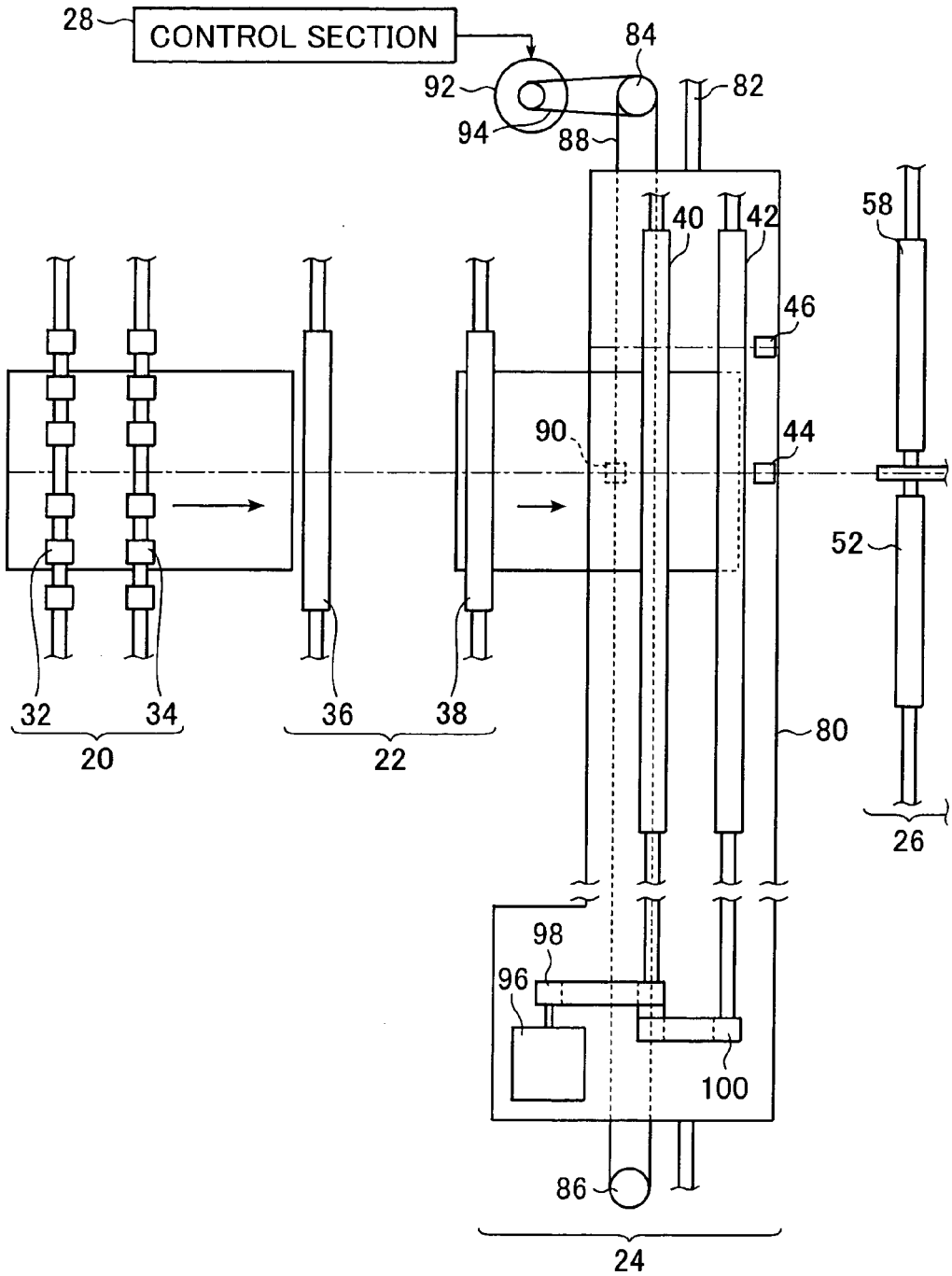
FIG. 4 illustrates a step in the flow for the transport of a cut sheet that is performed in the printer shown in FIG. 1.
Figure 5:
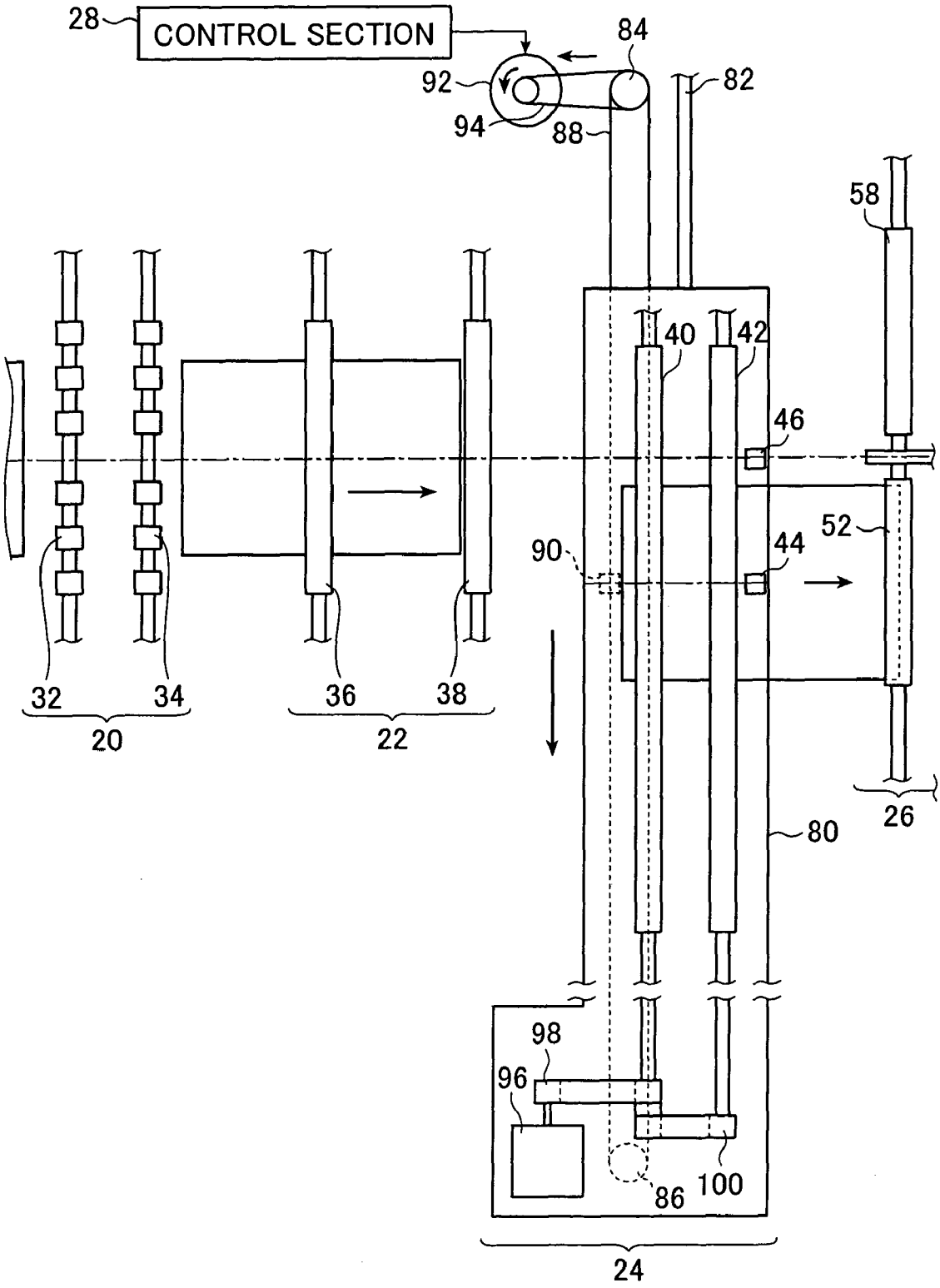
FIG. 5 illustrates another step in the flow for the transport of a cut sheet that is performed in the printer shown in FIG. 1.

Thereafter, another subsequent cut sheet is transported in the manner shown in FIG. 4. In this way, consecutively transported cut sheets are alternately distributed between the transport paths 48 and 50 and then transported in two lines.

In this case of two-line distribution, one only needs to move the table 80 in one direction and then move it in the other direction and there is no need to set a home position halfway on the width of movement of the table 80. Of course, a home position may be set on the moving table 80 which is so controlled that it returns to the home position after movement in either direction.

In addition, the table 80 ends its movement before the advancing end of a cut sheet reaches the roller pair 52 or 58, so the roller pairs 52 and 58 need not disengage the cut sheet out of the nipped state before it is received into the associated transport path. This offers the advantage of simplified control.

FIGS. 8A to 8D are timing charts depicting exemplary detection or control signals that are either supplied to or generated in the control section 28.

Figures 8A, 8B, 8C, 8D:
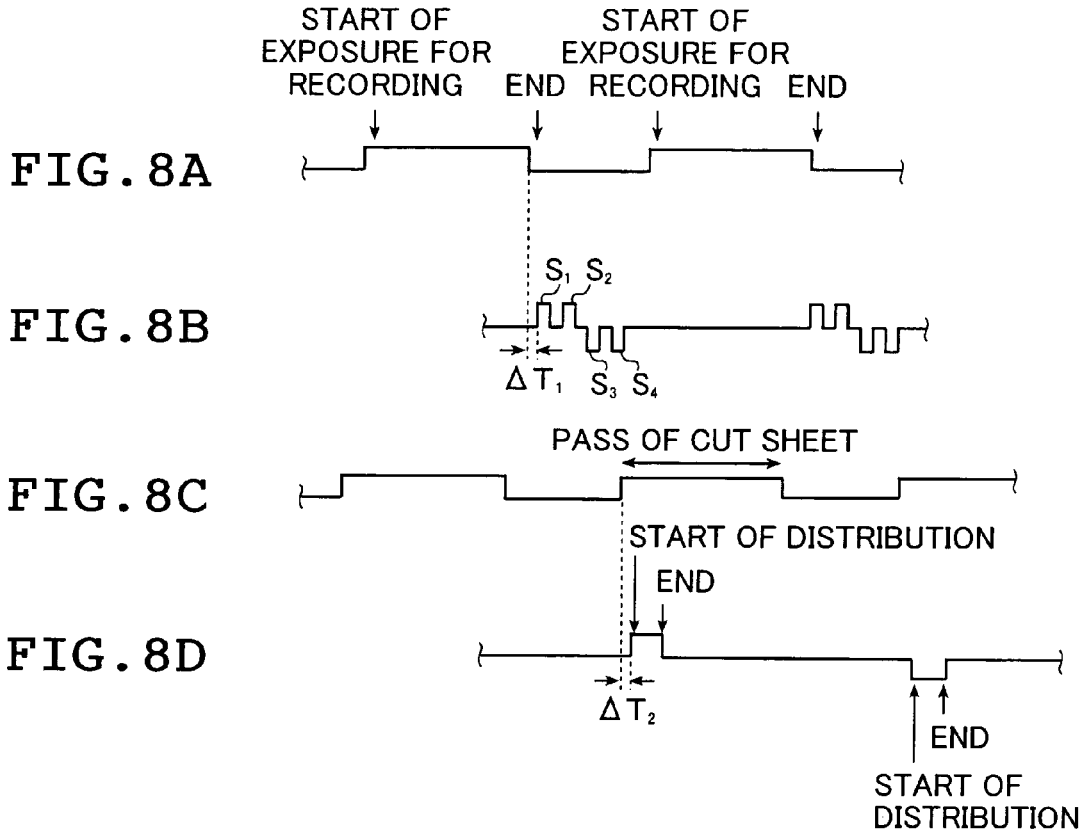
FIGS. 8A–8D are timing charts showing exemplary detection or control signals that are obtained or generated from the printer shown in FIG. 1.

FIG. 8A shows an exemplary detection signal that is sent from the position detecting sensor 35 in the exposing section 20 to the control section 28. FIG. 8B shows exemplary control signals to a solenoid (not shown) that is driven in order perform nip ON/OFF on the nip rollers of the roller pairs 36 and 38 in the auxiliary scan receiving section 22. FIG. 8C shows exemplary detection signals from the position detecting sensors 44 and 46 in the distributing section 24. FIG. 8D shows an exemplary control signal for controlling the driving of the drive motor 92.

As shown in FIG. 8A, the rise of a detection signal triggers the start of exposure for recording, which ends after the lapse of a specified time period. When the position detecting sensor 35 detects the pass of the trailing end of the cut sheet (i.e., when the detection signal falls), control signals $S_1$–$S_4$ are generated after the lapse of a time interval $\Delta T_1$ (see FIG. 8B) and supplied to a solenoid (not shown) that is driven to perform nip ON/OFF on the nip rollers of the roller pairs 36 and 38. In response to the signal $S_1$, the nip roller 36*b* moves downward as shown in FIG. 3B to get the nip ON state and in response to the signal $S_2$, the nip roller 38*b* moves downward as shown in FIG. 3D to get the nip ON state. On the other hand, in response to the signal $S_3$, the nip roller 36*b* moves upward as shown in FIG. 3E to get the nip OFF state and in response to the signal $S_4$, the nip roller 38*b* moves upward as shown in FIG. 3F to get the nip OFF state.

When the cut sheet passes through the auxiliary scan receiving section 22 and reaches the distributing section 24, the position detecting sensor 44 (or 46) detects the pass of the advancing end of the cut sheet. When a time interval of $\Delta T_2$ passes after this detection of the pass of the cut sheet's advancing end, a control signal for controlling the driving of the drive motor 92 is generated in the control section 28 as shown in FIG. 8D, whereupon the drive motor 92 is driven to start distribution of cut sheets. As shown in FIGS. 4–7, the table 80 alternately moves upward and downward to distribute the consecutively transported cut sheets, so the polarity of the drive signal to the drive motor 92 also changes alternately as shown in FIG. 8D.

In this way, the distribution in the distributing section 24 starts in synchronism with the pass of the advancing end of each cut sheet, namely, the distribution is controlled with reference to the advancing end of cut sheets, and among the various roller pairs located around the distributing section 24, it is only the roller pairs 36 and 38 that need be controlled for nip ON/OFF during distribution. If one controls the distribution without reference to the advancing end of cut sheets, the roller pairs that are subjected to control of nip ON/OFF must be determined in accordance with the length of cut sheets and the sequence of control becomes cumbersome. This is another reason why it is preferred to control the distribution with reference to the advancing end of cut sheets.

In the printer 1, the position detecting sensors 44 and 46 detect a moment when the advancing end of the cut sheet pass by the roller pair 42, and the control section 28 controls a start of the distribution in accordance with the timing of the detection. However, without the position detecting sensors 44 and 46, the invention can control the start of the distribution after a lapse of a specified time period after the exposure/recording controlled by the control section 28 ends. Specifically, clock pulses generated from the moment when the exposure/recording is finished may be counted and the number of counted pulses may be used as the information on the position of the cut sheet in the direction of transport. In addition, the moment when the exposure/recording starts, or the moment when the position detection sensor 35 detects the pass of the cut sheet, or the moment when the light-sensitive material is cut to a specified length to make the cut sheet in the cutter section 14 may be used as the start point from which the lapse of time is counted for controlling the distribution of the cut sheet, in stead of using the moment when the advancing end of cut sheet is detected by the position detection sensors 44 and 46. In this case, the specified time period from the start point is calculated based on the length of the cut sheet, the gap between successively transported cut sheets and a transport speed of the cut sheets. Then, compared with the calculated time period and the counted lapse of time from the start point, one can estimates a timing when the advancing end of the cut sheet passes by the roller pairs 42, namely a timing of the start of the distribution of the cut sheet.

The cut sheets distributed in the manner described above are transported by means of the roller pairs 52/54 and 58/60 which are independently driven on the transport paths 48 and 50 and then passed through the speed regulating roller pairs 56 and 62, in which they are slowed down to match the speed of their transport in the processor 4. Note that the transport speed is identical in the cutter section 14, back printing section 16, registering section 19, exposing section 20, auxiliary scan receiving section 22, distributing section 24 and the roller pairs 52/54 and 58/60 in the delivery section 26 but that it decreases at the speed regulating roller pairs 56 and 62 and subsequent stages. Because of this design, the interval between consecutive cut sheets that are being transported in two lines is sufficiently shortened that the processor 4 can achieve efficient development and other treatment steps.

Described above is the procedure for transport in the two-line mode.

If the transport is in the single rather than two-line mode, the roller pairs in the auxiliary scan receiving section 22 and those in the distributing section 24 are all in the nip OFF state and the cut sheet is transported by the auxiliary scanning roller pairs 32 and 34. When the step of exposure for recording ends, the roller pairs 52, 54, 58 and 60 in the delivery section 26 are in the nip ON state and transport the cut sheets.

Figure 9A:
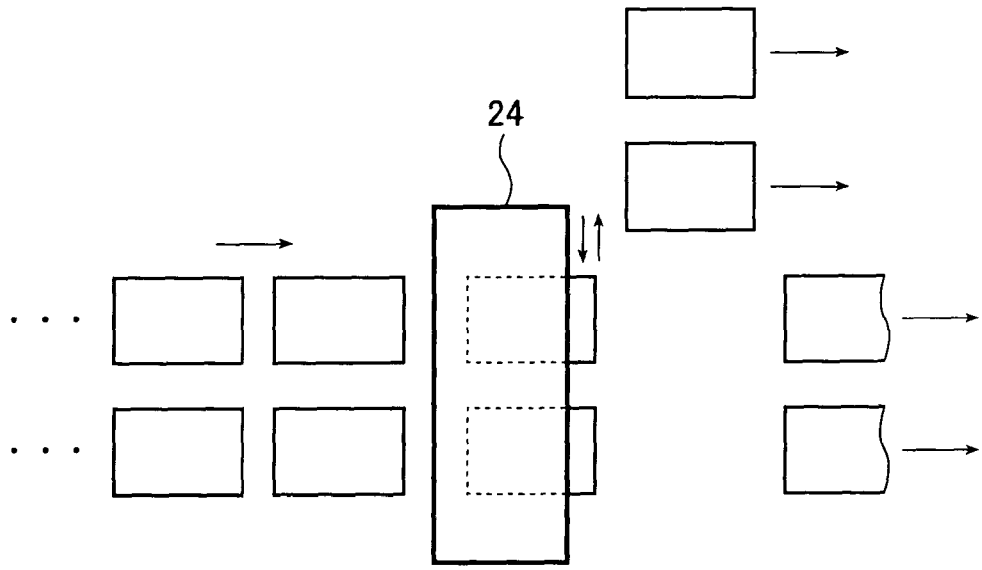
FIGS. 9A and 9B illustrate other embodiments of distributing cut sheets of the invention.
Figure 9B:
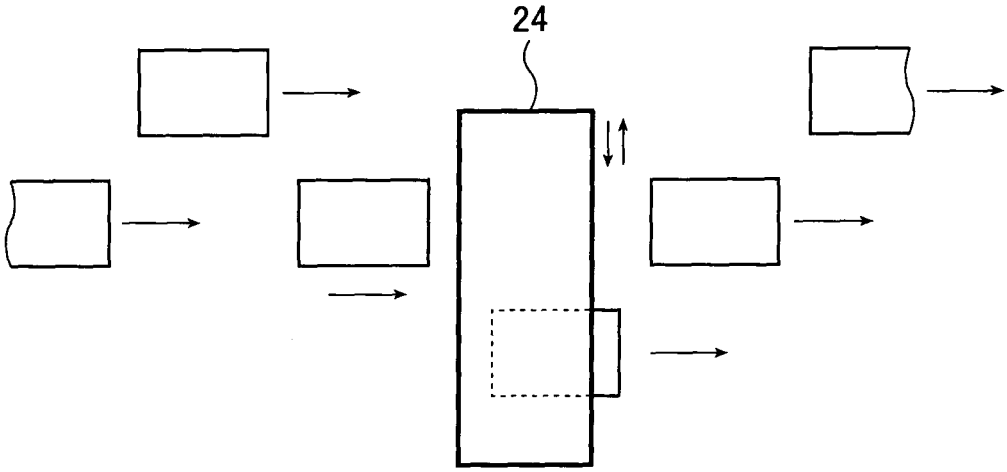

In the above described distribution, transported cut sheets are distributed from a single line to two lines or to keep a single line of cut sheets. In this invention transported cut sheets can be distributed from a plurality of lines to more plural lines. For example, as FIG. 9A illustrates, two-lines of transported cut sheets can be distributed into four-lines. As FIG. 9B illustrates, two-lines of alternately transported cut sheets can be distributed into three lines.

If desired, one may adopt a distribution degenerate mode in which even cut sheets of a size that should appropriately require transport in the two-line mode are not distributed in the distributing section 24, nor are they subjected to the nip ON/OFF control associated with distribution. Alternatively, one may adopt a compulsory selection mode in which in response to the operator's instruction, the setting of the two-line or one-line transport mode as well as the setting of those roller pairs which should be subjected to the nip ON/OFF control are effected in a compulsory manner.

If the registering section 18 and the exposing section 20 of the printer 1 has a white edge adjusting capability by which the cut sheets to be exposed for recording are transported, with their position in a width direction perpendicular to the direction of transport being offset typically for the purpose of ensuring that the white edges of photographic prints are arranged uniformly, the distance over which the table 80 is moved may be controlled to be variable in accordance with the amount of offset in order to ensure that the cut sheets being transported in an offset state are adjusted to become offset-free in the distributing section 24. By means of this design, one can reduce the unevenness in development and subsequent processing that would occur if the cut sheets were transported in an offset state through the processor 4.

Needless to say, one may adopt a design in which the widthwise position of cut sheets are varied subtly in the registering section 18 and their distribution in the distributing section 24 are adjusted accordingly such that the cut sheets being delivered into the processor 4 are held constant in their widthwise position.

Furthermore, if the widthwise position of the cut sheets in the process of distribution in the distributing section 24 is varied by small amounts, one can reduce the local wear of roller pairs, thereby suppressing the deposition of worn particles on the cut sheets that results from the local wear of roller pairs.

On the foregoing pages, the sheet distributor, image recorder and sheet distributing method of the present invention have been described in detail. However, the present invention is by no means limited to the foregoing embodiment and it should of course be understood that various improvements and modifications can be made without departing from the scope and spirit of the invention. For example, the distributor and image recorder of the invention can be applied not only to printers that perform exposure for printing using optical beams but also to a printer that perform exposure for printing using electroluminescence light emitting elements or to ink-jet printers that ejects droplets of ink on the cut sheet for printing and the like. The sheet distribution of the invention can be preferably applied to a system which records image by scanning each line or in several lines of the image in the direction perpendicular to the transport direction of the cut sheet.

As described above in detail, according to the invention, transported cut sheets of recording material of specified lengths can be distributed into a plurality of lines without stopping them, so the transport speed can be increased compared to the conventional method of distribution which requires the cessation of transport.

In addition, the moving unit carrying the two roller pairs through which the recording material is being transported is moved laterally, so in the absence of any parts that slidably contact them, the two roller pairs have better durability than in the prior art.

Further, sheets of the recording material are distributed with their transport speed held constant, so the invention is suitable for a control sequence such as one for digital photoprinters of a type that scans the recording material as it is transported in an auxiliary scanning direction. Further in addition, the invention has two transport modes, one being for multiple-line transport and the other for single-line transport, and they are so set that one transport mode is switched to the other and vice versa in accordance with the length of the recording material in the direction of transport. Hence, the setting for the distance from the recording section to the distributing section as measured in the direction of transport can be made smaller to shorten the transport path and this helps provide a cost-effective and feasible image recorder.

As yet another advantage, the transport roller pairs located before and after the transport path in the distributor are free to disengage the recording material out of the nipped state and, hence, those transport roller pairs will not be an impediment to the process of distribution.

What is claimed is:

1. A sheet distributor with which supplied sheets of a specified length are distributed to a plurality of lines of sheets, comprising:

a transport unit which keeps transporting each supplied sheet in a direction of transport while the sheet is being distributed to the plurality of lines of sheets;

a moving unit which moves said transport unit laterally in a direction perpendicular to the direction of transport of the sheets when the sheet is transported by means of said transport unit;

a position information obtaining device which obtains information on a position of the sheet in the direction of transport when the sheet is transported by means of said transport unit and before the sheet is distributed; and a control section that controls the start of the movement of said moving unit in accordance with the information on the position as obtained from said position information obtaining device.

2. The sheet distributor according to claim 1, wherein said transport unit has a driving roller and a nip roller which cooperates with said driving roller to nip and transport a sheet.

3. The sheet distributor according to claim 1, wherein said position information obtaining device is a position detecting sensor that detects the position of the sheet in the direction of the transport and said control section controls the start of the movement of said moving unit in accordance with a timing of detecting the position of the sheet as obtained from said position detecting sensor.

4. The sheet distributor according to claim 1, wherein said transport unit comprises two roller pairs arranged parallel to each other along the direction of transport of said sheet.

5. The sheet distributor according to claim 4, wherein said position information obtaining device is located on the moving unit, after the two roller pairs, along the direction of transport of said sheet.

6. The sheet distributor according to claim 1, wherein said moving unit comprises a moving table.

7. An image recorder that records a desired image on a specified length of recording material in sheet form being transported, comprising:

a recording section that records an image on the recording material in transport by scanning in a direction perpendicular to the direction of transport of the recording material; and a recording material distributing section which is provided downstream of said recording section in a direction of transport and with which supplied sheets of the recorded recording material are distributed to a plurality of lines, comprising a transport unit which keeps transporting each supplied sheet of the recording material with the recorded image in the direction of transport while it is being distributed, a moving unit which moves said transport unit laterally in a direction perpendicular to the direction of transport of the recording material when it is transported by means of said transport unit, a position information obtaining device which obtains information on a position of the sheet in the direction of transport when it is transported by means of said transport unit and before the sheet is distributed; and a control section that controls the start of the movement of said moving unit in accordance with the information on the position as obtained from said position information obtaining device.

8. The image recorder according to claim 7, wherein said position information obtaining device is a position detecting sensor that detects the position of the sheet in the direction of the transport and said control section controls the start of the movement of said moving unit in accordance with a timing of detecting the position of the sheet as obtained from said position detecting sensor.

9. The image recorder according to claim 7, which has a multiple-line transport mode and a single-line transport mode, the former being such that sheets of the recording material are distributed by said recording material distributing section to transport the sheets in a plurality of lines and the latter being such that sheets of the recording material are not distributed by said recording material distributing section but are transported in a single line. either mode of said multiple-line transport mode and said single-line transport mode being chosen and controlled by said control section.

10. The image recorder according to claim 7, wherein said transport unit has a driving roller and a nip roller which cooperates with said driving roller to nip and transport the recording material.

11. The image recorder according to claim 10, wherein the nip roller of said transport unit in said recording material distributing section is free to move relative to said driving roller so as to disengage the recording material out of the nipped state; and the nip roller of said transport unit cooperates with said driving roller to nip the recording material in a multiple-line transport mode and moves away from said driving roller so as to disengage the recording material out of said nipped state in a single-line transport mode, said multiple-line transport mode being such that sheets of the recording material are distributed by said recording material distributing section to transport the sheets in a plurality of lines and said single-line transport mode being such that sheets of the recording material are not distributed by said recording material distributing section but are transported in a single line.

12. The image recorder according to claim 10, which chooses a single-line transport mode in a case where the length of the sheet of the recording material in the direction of transport is greater than the distance from the recording position where scanning is performed in said recording section to said nip roller that is located downstream of said recording section in the direction of transport, said single-line transport mode being such that sheets of the recording material are not distributed by said recording material distributing section but are transported in a single line.

13. The image recorder according to claim 10, wherein the recording material in sheet form has its length set from among a plurality of predetermined lengths and provided by cutting to the specified length, and wherein said transport unit has two roller pairs, each of which consists of the nip roller and the driving roller, located away from each other in a distance in the direction of transport, and the distance is shorter than the length which is the shortest of all settings for the length of the recording material in the direction of transport.

14. The image recorder according to claim 7, wherein a delivery section for delivering the recording material into a post-processing unit and which has delivery roller pairs provided downstream of said recording material distributing section in the direction of transport, and herein said moving unit completes its lateral movement before the advancing end of the recording material being transported from said recording material distributing section reaches one of the delivery roller pairs in said delivery section that is the closest to said recording material distributing section.

15. The image recorder according to claim 14, wherein said delivery section adjusts the transport speed such that it matches the transport speed in said post-processing unit.

16. The image recorder according to claim 7, which has an auxiliary scan receiving section between said recording section and said recording material distributing section. said auxiliary scan receiving section having a roller pair and supporting a portion of the recording material that projects from said recording section as the result of transport during recording in said recording section, the roller pair in said auxiliary scan receiving section comprising a driving roller and a nip roller that is free to move relative to said driving roller so that it is free to disengage the recording material out of the nipped state.

17. The image recorder according to claim 4, wherein said recording material distributing section is provided in a cornering portion of the recording materials transport path such that during distribution in said recording material distributing section, the direction of transport is changed to become out-of-plane with respect to an exposing direction of the recording material.

18. The image recorder according to claim 7, wherein when one of a length or a width of the sheet exceeds a predetermine value, the recording material distribution section transports the sheet in a single line transport mode.

* * * * *